US009633609B2

(12) United States Patent
Kao et al.

(10) Patent No.: US 9,633,609 B2
(45) Date of Patent: Apr. 25, 2017

(54) DISPLAY COMPENSATING METHOD AND DISPLAY COMPENSATING SYSTEM

(71) Applicant: Wistron Corporation, New Taipei (TW)

(72) Inventors: Meng-Chao Kao, New Taipei (TW); Hui-Chen Lin, New Taipei (TW)

(73) Assignee: Wistron Corporation, New Taipei (TW)

( * ) Notice: Subject to any disclaimer, the term of this patent is extended or adjusted under 35 U.S.C. 154(b) by 75 days.

(21) Appl. No.: 14/480,616

(22) Filed: Sep. 8, 2014

(65) Prior Publication Data

US 2015/0269895 A1 Sep. 24, 2015

(30) Foreign Application Priority Data

Mar. 21, 2014 (TW) ..... 103110779 A

(51) Int. Cl.

| | |
|---|---|
| ***G09G 3/36*** | (2006.01) |
| ***G09G 3/34*** | (2006.01) |
| ***G09G 5/02*** | (2006.01) |
| ***G09G 3/00*** | (2006.01) |

(52) U.S. Cl.

CPC ..... *G09G 3/3426* (2013.01); *G09G 3/006* (2013.01); *G09G 2320/0233* (2013.01); *G09G 2320/0285* (2013.01); *G09G 2320/0646* (2013.01); *G09G 2360/145* (2013.01); *G09G 2360/16* (2013.01)

(58) Field of Classification Search

USPC ..... 345/690

See application file for complete search history.

(56) References Cited

U.S. PATENT DOCUMENTS

2010/0157044 A1* 6/2010 Mori ..... G06T 7/0004 348/92
2010/0259533 A1* 10/2010 Yamashita ..... G09G 3/3233 345/213

(Continued)

FOREIGN PATENT DOCUMENTS

CN 1996441 A 7/2007
CN 101339736 A 1/2009

(Continued)

OTHER PUBLICATIONS

Office action mailed on Nov. 25, 2015 for the Taiwan application No. 103110779, filed: Mar. 21, 2014, p. 1 line 14, p. 2-7 and p. 8 line 1-15.

(Continued)

*Primary Examiner* — Carolyn R Edwards
*Assistant Examiner* — Krishna Neupane
(74) *Attorney, Agent, or Firm* — Winston Hsu; Scott Margo

(57) ABSTRACT

A display compensating method for eliminating a mura of a display panel. The display compensating method includes capturing an image displayed by the display panel to generate a capturing image; generating a plurality of compensation results according to a plurality of brightness values in the capturing image corresponding to a plurality of display units of the display panel; and setting brightness of the plurality of display units according to the plurality of compensation results to eliminate the mura of the display panel.

34 Claims, 12 Drawing Sheets

(56) References Cited

U.S. PATENT DOCUMENTS

| | | | | |
|---|---|---|---|---|
| 2011/0037785 | A1* | 2/2011 | Shiomi | G09G 3/3426 345/690 |
| 2012/0293650 | A1* | 11/2012 | Murakami | G02B 21/365 348/135 |
| 2013/0016141 | A1* | 1/2013 | Chang | G09G 3/3426 345/691 |
| 2013/0141409 | A1* | 6/2013 | Kosei | G09G 3/006 345/207 |
| 2014/0204110 | A1* | 7/2014 | Miki | G09G 3/20 345/589 |
| 2014/0210841 | A1 | 7/2014 | Song | |

FOREIGN PATENT DOCUMENTS

| | | |
|---|---|---|
| CN | 102231016 A | 11/2011 |
| TW | 201303833 | 1/2013 |

OTHER PUBLICATIONS

Office action mailed/issued on Feb. 7, 2017 for CN application No. 201410138555.2, p. 3 line 4-31 and pp. 4-6.

* cited by examiner

DISPLAY COMPENSATING METHOD AND DISPLAY COMPENSATING SYSTEM

BACKGROUND OF THE INVENTION

1. Field of the Invention

The present invention relates to a display compensating method and a display compensating system, and more particularly, to a display compensating method and a display compensating system capable of precisely determining a mura phenomenon in a display panel and performing display compensation to eliminate the mura phenomenon.

2. Description of the Prior Art

Display panels may display non-uniform brightness in ripple appearance, such as horizontal stripes, 45-degree stripes, large blocks or other shapes with non-uniform brightness, etc., due to poor backlight design or non-uniformity of optical films in light guide plates. These flaws are generally called mura phenomenon, wherein "mura" is a Japanese word and becomes a worldwide used term as more and more display panels are produced by Japanese companies.

In order to produce display panels without mura, the prior art method is to perform tests by testing staffs on display panels which display a black monochrome image or other fixed wavelength monochrome image in different angles, to determine whether the display panels have the mura phenomenon and discard the display panels which have the mura phenomenon. However, personal subjective determinants made by the testing staffs may make the testing results inconsistent or unreliable. For example, it happens that some display panels have mura but are determined as no mura, causing the display panels to be rejected by customers, or some display panels just have very slight mura and are discarded since the testing results indicate that they have mura, causing a manufacture yield to be too low. Therefore, it is necessary to improve the prior art.

SUMMARY OF THE INVENTION

It is therefore a primary objective of the present invention to provide a display compensating method and a display compensating system, which precisely determines a mura phenomenon in a display panel and performs display compensation to eliminate the mura.

An embodiment of the invention discloses a display compensating method, for eliminating a mura of a display panel. The display compensating method comprises capturing an image displayed by the display panel to generate a captured image; generating a plurality of compensation results according to a plurality of brightness values corresponding to a plurality of display units of the display panel in the captured image; and configuring brightness of the plurality of display units according to the plurality of compensation results to eliminate the mura of the display panel.

An embodiment of the invention further discloses a display compensating system, comprising a display device, which comprises a display panel comprising a plurality of display units for displaying image; a plurality of backlight elements for providing display light source of the display panel; a storage unit for storing a plurality of compensation results; and a control unit coupled to the display panel, the plurality of backlight elements and the storage unit for configuring a plurality of brightness of the plurality of display units according to the plurality of compensation results to eliminate the mura of the display panel; an image capturing device for capturing an image displayed by the display panel to generate a captured image; and a processor device coupled to the image capturing device and the display panel for generating a plurality of compensation results according to the plurality of brightness values corresponding to the plurality of display units of the display panel in the captured image and storing a plurality of compensation results in the storage unit of display device.

These and other objectives of the present invention will no doubt become obvious to those of ordinary skill in the art after reading the following detailed description of the preferred embodiment that is illustrated in the various FIGures and drawings.

DETAILED DESCRIPTION

Figure 1A:
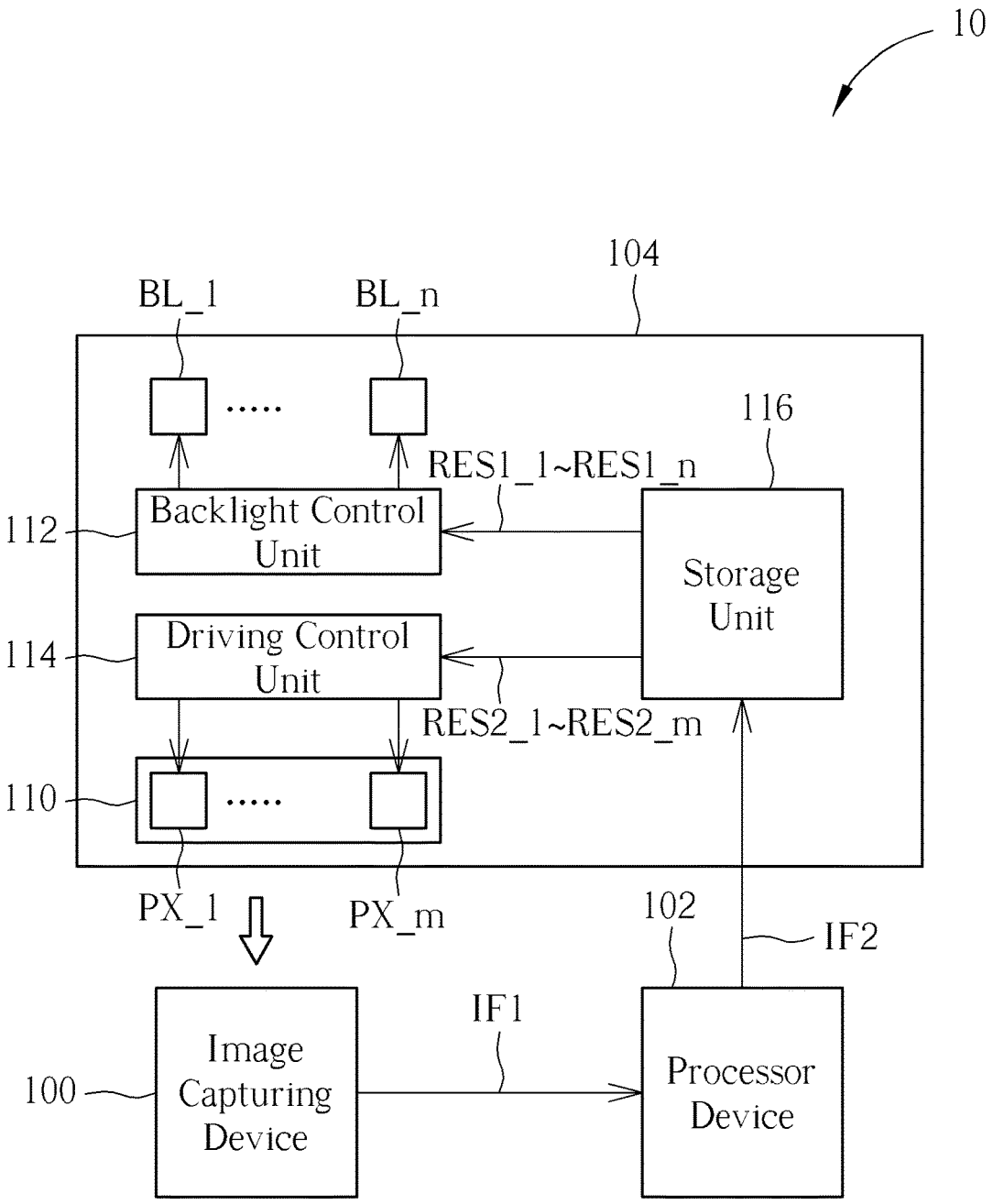
FIG. 1A is a schematic diagram of a display compensating system according to an embodiment of the invention.

Please refer to FIG. 1A, which is a schematic diagram of a display compensating system 10 according to an embodiment of the present invention. As shown in FIG. 1A, the display compensating system 10 comprises an image capturing device 100, a processor device 102 and a display device 104. The display device 104 may be an electronic device such as a computer, a smart television, a smart phone, a tablet, etc., and comprises a display panel 110, a backlight control unit 112, a driving control unit 114, a storage unit 116 and backlight elements BL_1-BL_n. The display panel 110 comprises components such as driving transistors, polarizers, glass substrates, liquid crystal layers, color filters, etc., which form as pixels PX_1-PX_m to display images. The components of the display panel 110, such as driver transistors, polarizers, glass substrates, liquid crystal layers, color filters, etc., are known by those skilled in the art, which are not narrated herein, and represented as the pixels PX_1-PX_m for brevity. The backlight elements BL_1-BL_n are utilized for generating display light sources of the display panel 110, such that the display light sources penetrate through the components such as polarizers, glass substrates, liquid crystal layers, color filters, and polarizers of the display panel 110 and are perceived by human eyes.

In addition, the backlight control unit 112 is coupled to the storage unit 116 and the backlight elements BL_1-BL_n. The backlight control unit 112 is utilized for controlling lightening brightness of the backlight elements BL_1-BL_n and further compensating on the lightening brightness of the backlight elements BL_1-BL_n according to first compensation results RES1_1-RES1_*n* stored in the storage unit 116. The driving control unit 114 is coupled to the storage unit 116 and the pixels PX_1-PX_m. The driving control unit 114 drives the transistors of the pixels PX_1-PX_m to conduct and charge a capacitor between two glass substrates of the pixels PX_1-PX_m through source terminals of the transistors, such that the pixels PX_1-PX_m are displayed in various brightness correspondingly. Furthermore, the driving control unit 114 also performs compensation on display brightness of the pixels PX_1-PX_m according to second compensation results RES2_1-RES2_*m* stored in the storage unit 116.

Figure 1B:
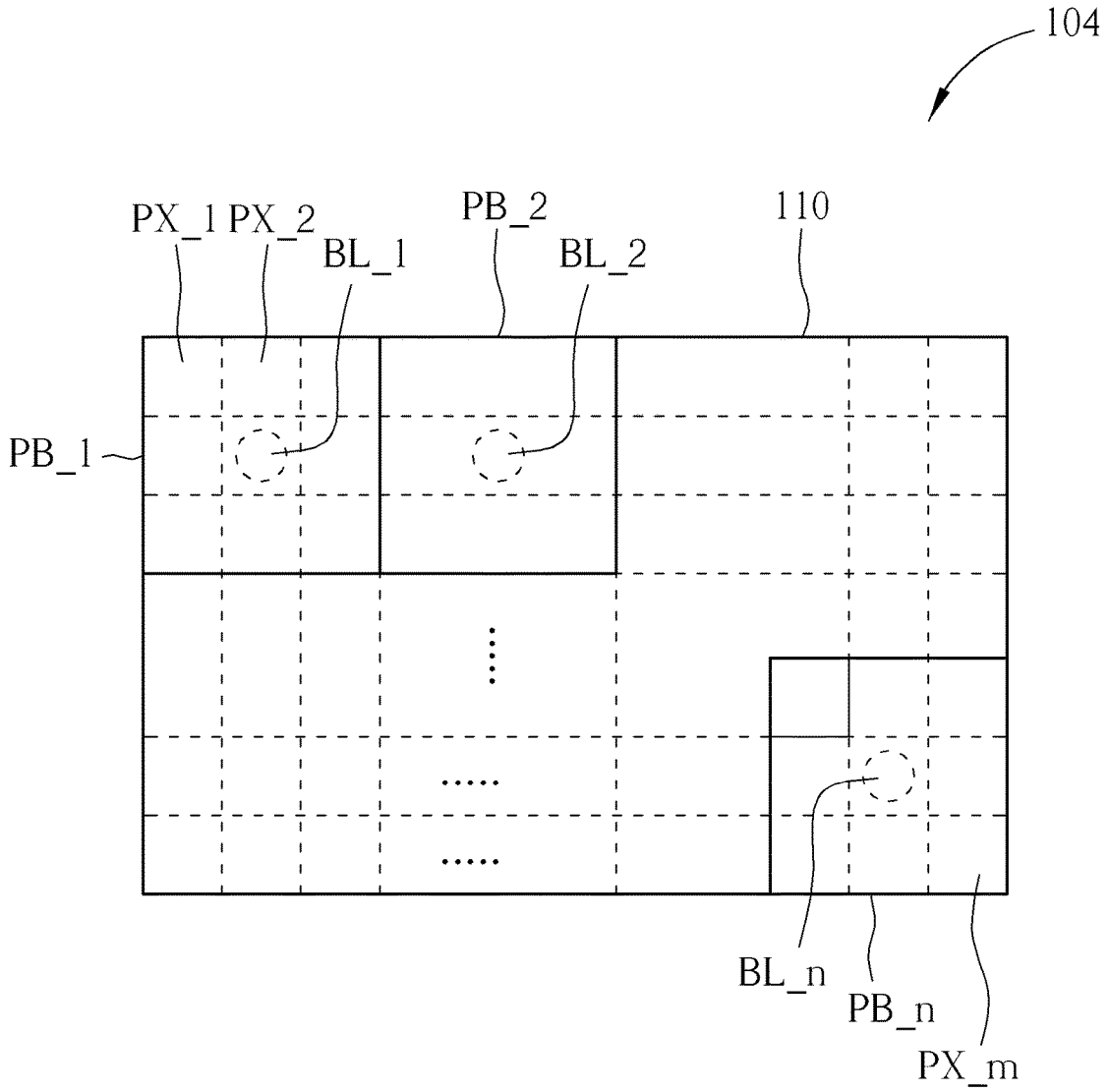
FIG. 1B is a schematic diagram of a front view of the display panel 110 in FIG. 1A.

Please refer to FIG. 1B. FIG. 1B is a schematic diagram of a front view of the display panel 110 in FIG. 1A. As shown in FIG. 1B, according to locations of the backlight elements BL_1-BL_n in back of the display panel 110 corresponding to the display panel 110, the display panel 110 is divided into display blocks PB_1-PB_n, wherein block centers of the display blocks PB_1-PB_n are the locations of the backlight elements BL_1-BL_n corresponding to the display panel 110, but not limited thereto. The display blocks PB_1-PB_n may also be blocks which are not square, and modification can be made accordingly. In such a situation, the display light sources generated by the backlight elements BL_1-BL_n mostly become display light sources of pixels of the display blocks PB_1-PB_n, which means that the display brightness of the pixels PX_1-PX_m are generated by the backlight elements BL_1-BL_n corresponding to the display blocks PB_1-PB_n, which the pixels PX_1-PX_m belong to, and the display brightness of the pixels PX_1-PX_m are further controlled by the driving control unit 114, such that the pixels PX_1-PX_m are displayed in various brightness.

In addition, as shown in FIG. 1A, in the display compensating system 10, the image capturing device 100 is disposed in front of the display panel 110, which is an electronic device such as a camera for capturing an image displayed by the display panel 100, and transmits the captured image to the processor device 102 through a transmission interface IF1. The processor device 102 is coupled to the image capturing device 100 and the display panel 110, analyzes the captured imaged outputted by the image capturing device 100, generates the first compensation results RES1_1-RES1_*n* and the second compensation results RES2_1-RES2_*m*, and transmits the first compensation results RES1_1-RES1_*n* and the second compensation results RES2_1-RES2_*m* to the display panel 110 through a transmission interface IF2 to store the compensation results in the storage unit 116. The processor device 102 may be implemented by application-specific integrated circuits (ASIC), or by a processor and a storage device storing programming code, e.g., PC. The storage device may be read-only memory (ROM), random-access memory (RAM), CD-ROMs, magnetic tapes, floppy disks, optical data storage devices, etc., and are not limited herein.

Thereby, the display compensating system 10 displays a uniform color monochrome image such as a black monochrome image or other fixed wavelength monochrome image by controlling the display panel 110, captures the image displayed on the display panel 100 through the image capturing device 100, and generates a captured image PIC1 for the processor device 102. When the display panel 110 shows display blocks with non-uniform brightness due to poor backlight design, the processor device 102 analyzes the brightness corresponding to the display blocks PB_1-PB_n, which are divided according to the locations of the backlight elements BL_1-BL_n, in the captured image PIC1, and generates the first compensation results RES1_1-RES1_*n* to be stored in the storage unit 116, such that the backlight control unit 112 accesses the first compensation results RES1_1-RES1_*n* from the storage unit 116 to compensate the lightening brightness of the backlight elements BL_1-BL_n. Hence, the brightness displayed on the display blocks PB_1-PB_n is compensated as uniform, for eliminating the display blocks with non-uniform brightness in the display panel 110. Next, the display compensating system 10 captures the monochrome image with the uniform brightness blocks shown in the display panel 110 through the image capturing device 100, and generates a captured image PIC2 for the processor device 102. When the display panel 110 displays non-uniform pixel bright dots due to non-uniformity of light guide plates and optical films of diffusion sheets, the processor device 102 analyzes the brightness corresponding to the pixels PX_1-PX_m in the captured image PIC2, and generates the second compensation results RES2_1-RES2_*m* to be stored in the storage unit 116, such that the driving control unit 114 accesses the second compensation results RES2_1-RES2_*m* from the storage unit 116 to compensate the display brightness of the pixels PX_1-PX_m. Hence, the brightness displayed on the pixels PX_1-PX_m is compensated as uniform, for eliminating the non-uniform pixel bright dots in the display panel 110.

In other words, the display compensating system 10 first analyzes the brightness of the display blocks PB_1-PB_n in the captured image PIC1, and generates the first compensation results RES1_1-RES1_*n* for controlling the lightening brightness of the backlight elements BL_1-BL_n, to make the display blocks PB_1-PB_n display uniform brightness. Next, the display compensating system 10 analyzes the brightness of the pixels PX_1-PX_m in the captured image PIC2 with uniform brightness blocks, and generates the second compensation results RES2_1-RES2_*m* for compensating the display brightness of the pixels PX_1-PX_m, to make the pixels PX_1-PX_m display uniform brightness. In such a situation, the display compensating system 10 acquires a degree of severeness of a mura in the display panel 110 and determines whether the mura, which cannot be eliminated by compensation, is in the display panel 110. In other words, the display compensating system 10 precisely determines the unacceptable mura perceived by customers through the captured image PIC1 and the captured image PIC2, to avoid inconsistent determinant on the mura. Meanwhile, the display compensating system 10 further compensates the brightness of the backlight elements BL_1-BL_n and the pixels PX_1-PX_m according to the first compensation results RES1_1-RES1_*n* and the second compensation results RES2_1-RES2_*m*, to eliminate the mura with slight degree of severeness, so as to enhance a manufacture yield of display panels.

Figure 1C:
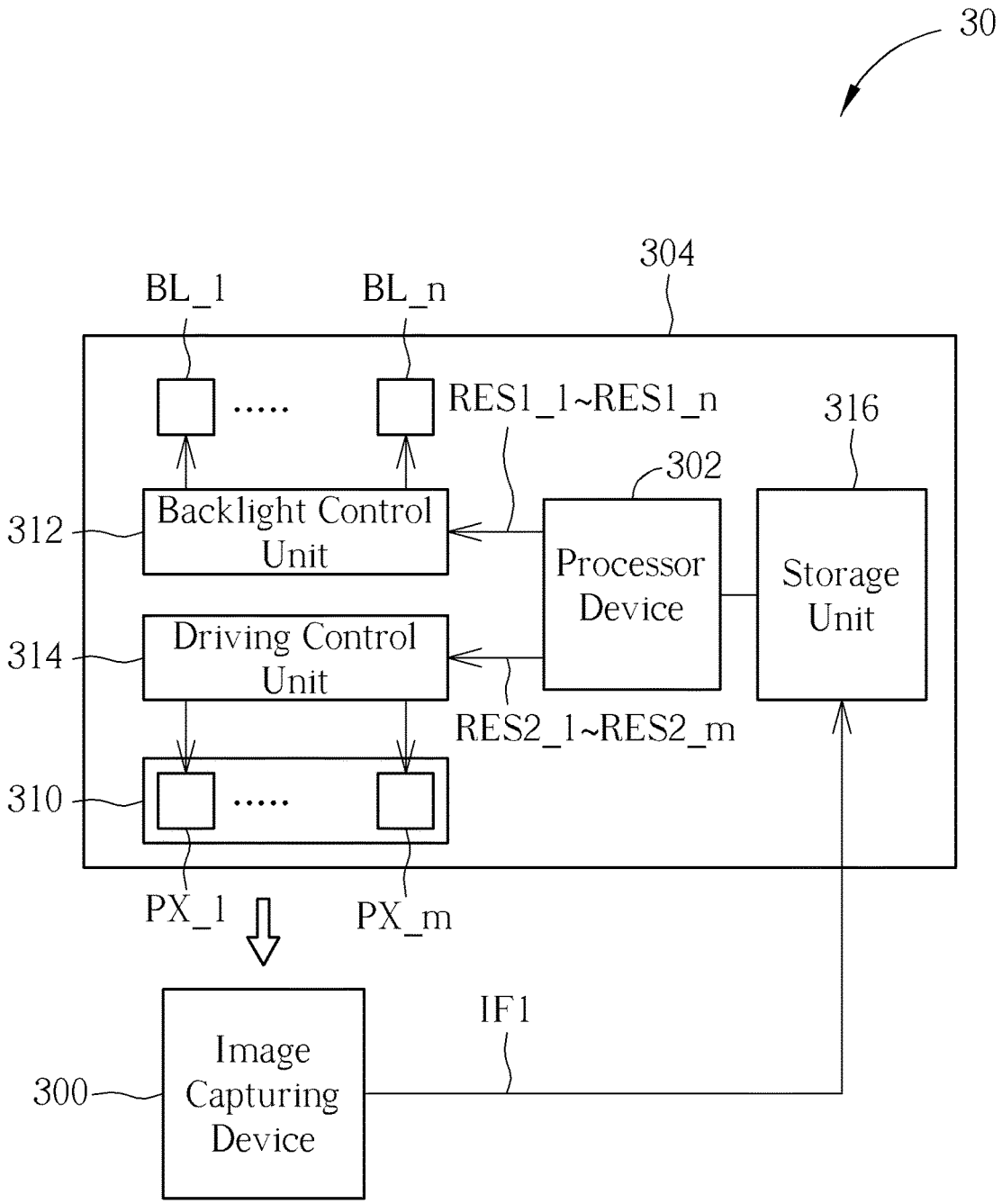
FIG. 1C is a schematic diagram of another display compensating system according to an embodiment of the invention.

Notably, the way to implement the display compensating system 10 is not limited to any certain connecting way. Modifications can be made according to practical requirements. For example, please refer to FIG. 1C. FIG. 1C is a schematic diagram of another display compensating system 30 according to an embodiment of the present invention. As shown in FIG. 1C, the display compensating system 30 comprises an image capturing device 300 and a display device 304. The display device 304 comprises a display panel 310, a backlight control unit 312, a driving control unit 314, a storage unit 316, backlight elements BL_1-BL_n and a processor device 302. Operations of the image capturing device 300, the display panel 310, the backlight control unit 312, the driving control unit 314, the storage unit 316 and the processor device 302 of the display compensating system 30 are all similar to those of the image capturing device 100, the display panel 110, the backlight control unit 112, the driving control unit 114, the storage unit 116 and the processor device 102 of the display compensating system 10, which may be refer to above description and not narrated herein. The difference between the display compensating system 30 and the display compensating system 10 is that the processor device 302 is disposed inside the display device 304. Hence, the display compensating system 30 stores the captured image outputted by the image capturing device 300 in the storage unit 316 via the transmission interface IF1, performs analysis via the processor device 302 reading the captured image stored in the storage unit 316, and generates the first compensation results RES1_1-RES1_*n* and the second compensation results RES2_1-RES2_*m*, to compensate the lightening brightness of the backlight elements BL_1-BL_n and the display brightness of the pixels PX_1-PX_m via the backlight control unit 312 and the driving control unit 314, respectively.

Figure 2:
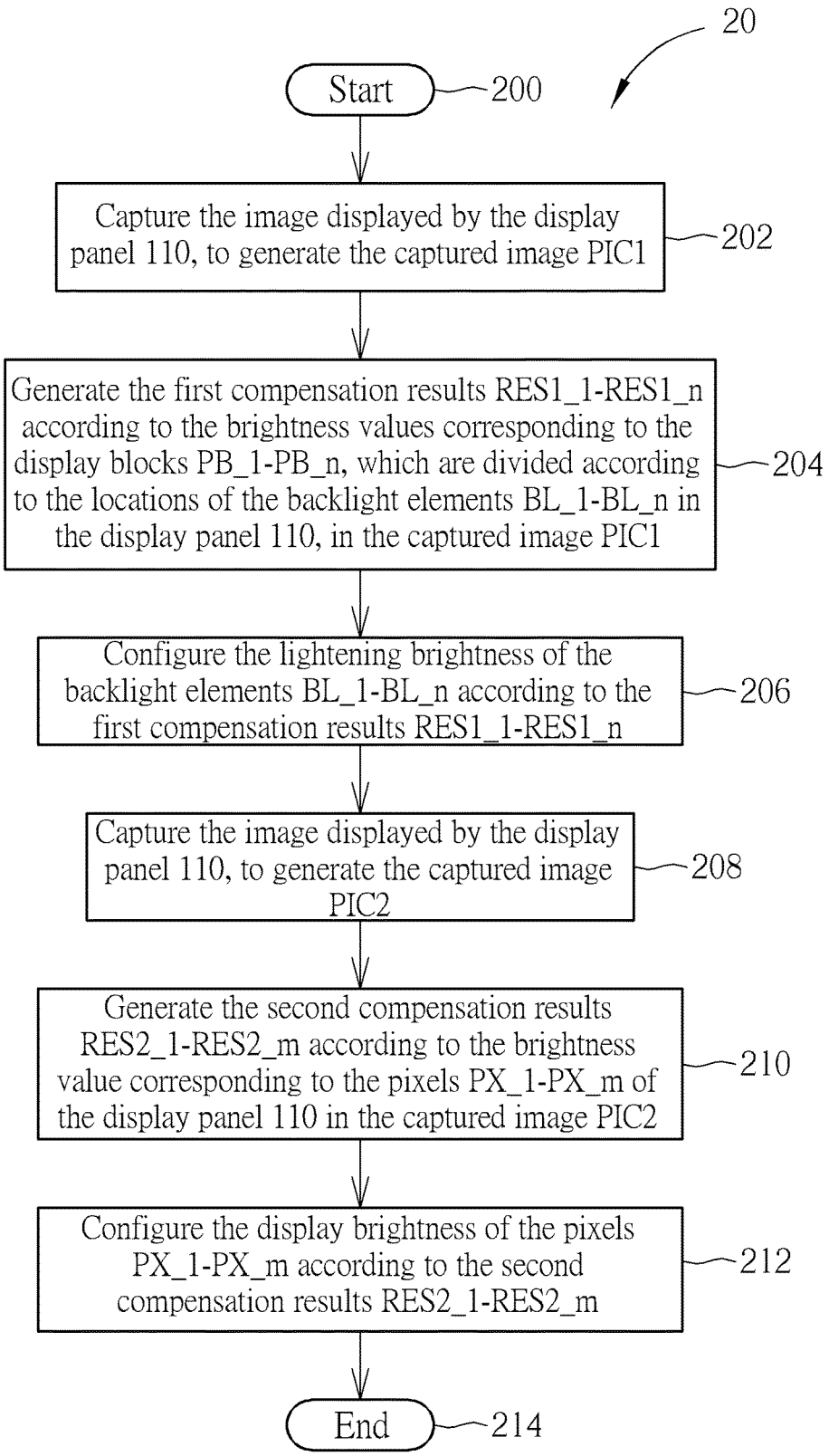
FIG. 2 is a schematic diagram of a display compensation process according to an embodiment of the invention.

A compensation process of the display compensating system 10 generating the first compensation results RES1_1-RES1_*n* and the second compensation results RES2_1-RES2_*m* so as to compensate the brightness of the backlight elements BL_1-BL_n and the pixels PX_1-PX_m may be referred to FIG. 2. FIG. 2 is a schematic diagram of a display compensation process 20 according to an embodiment of the present invention. The display compensation process 20 is executed by the display compensating system 10. As shown in FIG. 2, the display compensation process 20 comprises following steps:

Step 200: Start.

Step 202: Capture the image displayed by the display panel 110, to generate the captured image PIC1.

Step 204: Generate the first compensation results RES1_1-RES1_*n* according to the brightness values corresponding to the display blocks PB_1-PB_n, which are divided according to the locations of the backlight elements BL_1-BL_n in the display panel 110, in the captured image PIC1.

Step 206: Configure the lightening brightness of the backlight elements BL_1-BL_n according to the first compensation results RES1_1-RES1_*n*.

Step 208: Capture the image displayed by the display panel 110, to generate the captured image PIC2.

Step 210: Generate the second compensation results RES2_1-RES2_*m* according to the brightness value corresponding to the pixels PX_1-PX_m of the display panel 110 in the captured image PIC2.

Step 212: Configure the display brightness of the pixels PX_1-PX_m according to the second compensation results RES2_1-RES2_*m*.

Step 214: End.

According to the display compensation process 20, the display compensating system 10 generates the first compensation results RES1_1-RES1_*n* and the second compensation results RES2_1-RES2_*m*, to acquire the degree of severeness of the mura in the display panel 110 and precisely determines whether the mura, which cannot be eliminated by compensation, is in the display panel 110. Meanwhile, the display compensating system 10 further compensates the lightening brightness of the backlight elements BL_1-BL_n by utilizing the first compensation results RES1_1-RES1_*n* and compensates the display brightness of the pixels PX_1-PX_m by utilizing the second compensation results RES2_1-RES2_*m*, to eliminate the mura with slight degree of severeness, without affecting the overall display brightness of the display panel 110.

In detail, in Step 202, the display compensating system 10 utilizes the image capturing device 100 to capture the monochrome image with the uniform color initially displayed by the display panel 110 as the captured image PIC1, and transmits the captured image PIC1 to the processor device 102, to proceed analysis.

Figure 3:
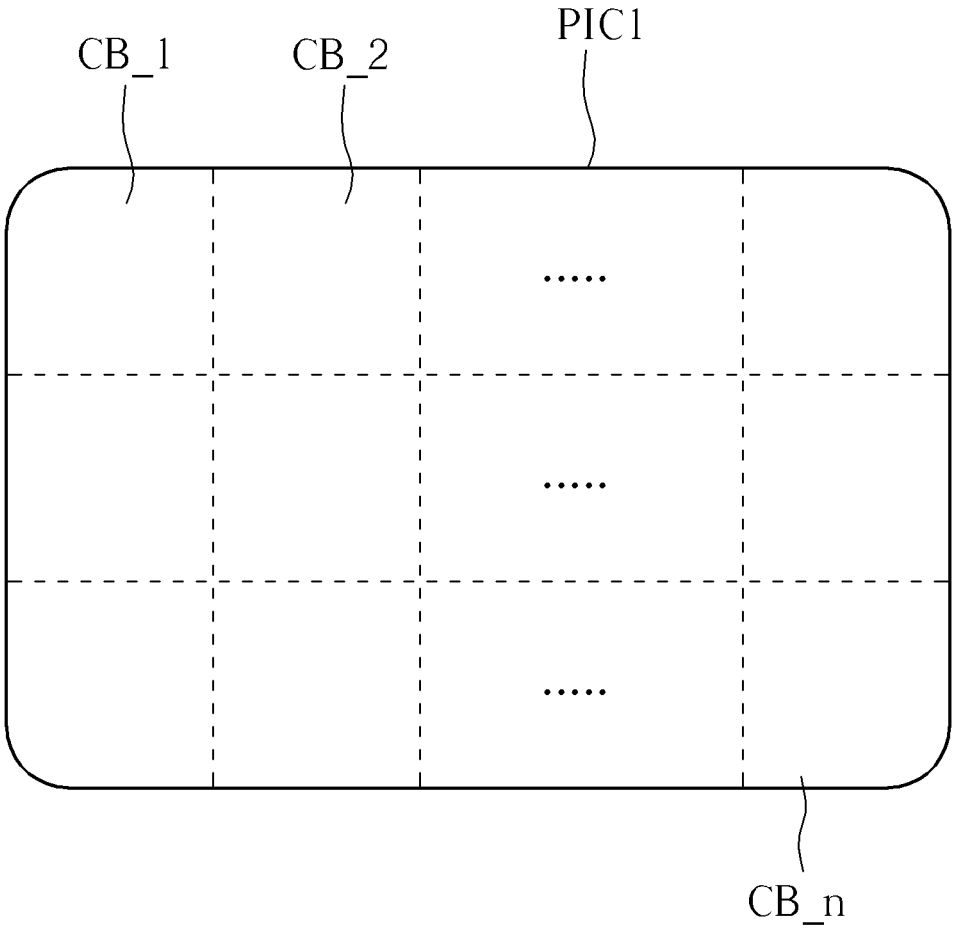
FIG. 3 is a schematic diagram of a captured image according to an embodiment of the invention.

In Step 204, the processor device 102 divides a summation of pixel values of the pixels in the captured image PIC1 by a total number of pixels in the captured image PIC1, to obtain an overall average brightness value AVGAL, representing the overall average brightness of the captured image PIC1. Please refer to FIG. 3. FIG. 3 is a schematic diagram of the captured image PIC1 according to an embodiment of the present invention. As shown in FIG. 3, according to proportional sizes of pixel blocks PB_1-PB_n on the display panel 110, the processor device 102 divides the captured image PIC1 into image blocks CB_1-CB_n, i.e., the proportional sizes of the pixel blocks PB_1-PB_n corresponding to the display panel 110 are the same as the proportional sizes of the image blocks CB_1-CB_n corresponding to the captured image PIC1. Next, the processor device 102 divides summations of pixel values of the pixels in the image blocks CB_1-CB_n by total numbers of pixels in the image blocks CB_1-CB_n, respectively, to obtain average brightness values AVGCB_1-AVGCB_n, respectively representing the average brightness of the image blocks CB_1-CB_n. The processor device 102 divides the overall average brightness value AVGAL by the average brightness values AVGCB_1-AVGCB_n, respectively, to acquire backlight adjustment values CBL_1-CBL_n. Since the backlight adjustment values CBL_1-CBL_n are inversely proportional to the average brightness values of the image blocks CB_1-CB_n in the captured image PIC1, the processor device 102 multiplies initial brightness values VIBL_1-VIBL_n of the backlight elements BL_1-BL_n by the backlight adjustment values CBL_1-CBL_n, respectively, to acquire lightening brightness values VOL_1-VOL_n, for compensating the average brightness of the image blocks CB_1-CB_n as uniform, to be the first compensation results RES1_1-RES1_*n*, and stores the first compensation results RES1_1-RES1_*n* in the storage unit 116.

Thereby, in Step 206, the backlight control unit 112 accesses the lightening brightness values VOL_1-VOL_n from the storage unit 116, and configures the lightening brightness of the backlight elements BL_1-BL_n to be the lightening brightness values VOL_1-VOL_n, such that the display brightness the display blocks PB_1-PB_n in the display panel 110 are compensated as uniform, to eliminate the blocks with non-uniform brightness in the display panel 110.

Figure 4:
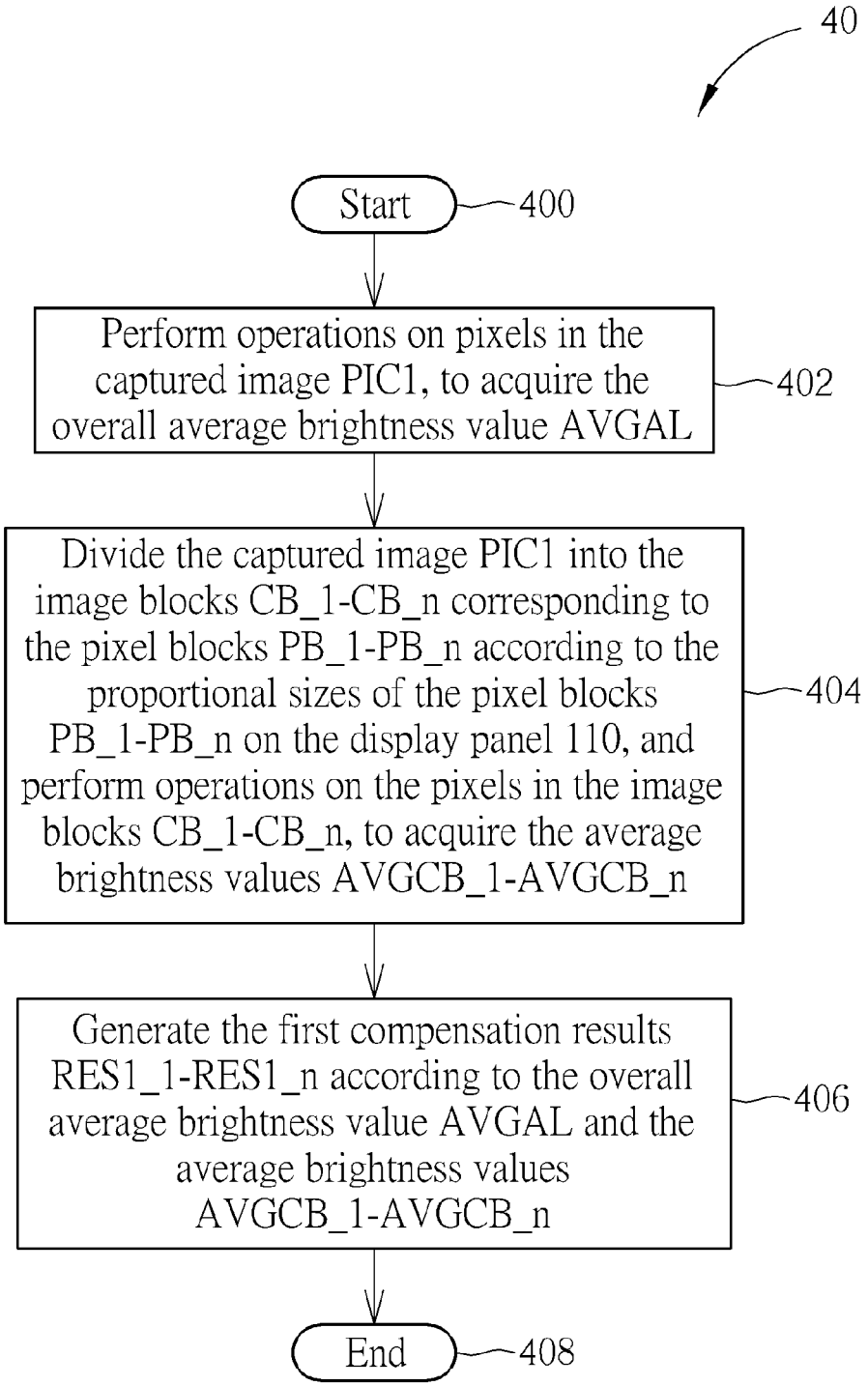
FIG. 4 is a schematic diagram of a backlight compensation process according to an embodiment of the invention.

The method of the display compensating system 10 generating the first compensation results RES1_1-RES1_*n* in Step 204 can be further summarized into a backlight compensation process 40. The backlight compensation process 40 is executed by the processor device 102 in FIG. 1A, which may be compiled as programming codes and stored in storage devices in the processor device 102 to instruct processor (s) of the processor device 102 to perform the compensation process. As shown in FIG. 4, the backlight compensation process 40 comprises following steps:

Step 400: Start.

Step 402: Perform operations on pixels in the captured image PIC1, to acquire the overall average brightness value AVGAL.

Step 404: Divide the captured image PIC1 into the image blocks CB_1-CB_n corresponding to the pixel blocks PB_1-PB_n according to the proportional sizes of the pixel blocks PB_1-PB_n on the display panel 110, and perform operations on the pixels in the image blocks CB_1-CB_n, to acquire the average brightness values AVGCB_1-AVGCB_n.

Step 406: Generate the first compensation results RES1_1-RES1_*n* according to the overall average brightness value AVGAL and the average brightness values AVGCB_1-AVGCB_n.

Step 408: End.

The details of each step of the backlight compensation process 40 can be referred to the relative paragraphs of the embodiments stated above, and are not narrated herein for brevity. Notably, in the above embodiments, the first compensation results RES1_1-RES1_*n* are the lightening brightness values VOL_1-VOL_n, utilized for controlling the lightening brightness of the backlight elements BL_1-BL_n as uniform. Meanwhile, the processor device 102 also determines whether the display blocks with non-uniform brightness in the display panel 110 are able to be eliminated by the compensation process, according to reasonableness of the lightening brightness values VOL_1-VOL_n. From the determination results, the manufactured display panel 110 is decided whether or not to be discarded.

In Step 208, the display compensating system 10 utilizes the image capturing device 100 to capture the image with the uniform brightness display blocks displayed by the display panel 110 as the captured image PIC2, and transmits the captured image PIC2 to the processor device 102, to proceed the analysis on brightness of pixels.

Figure 5A:
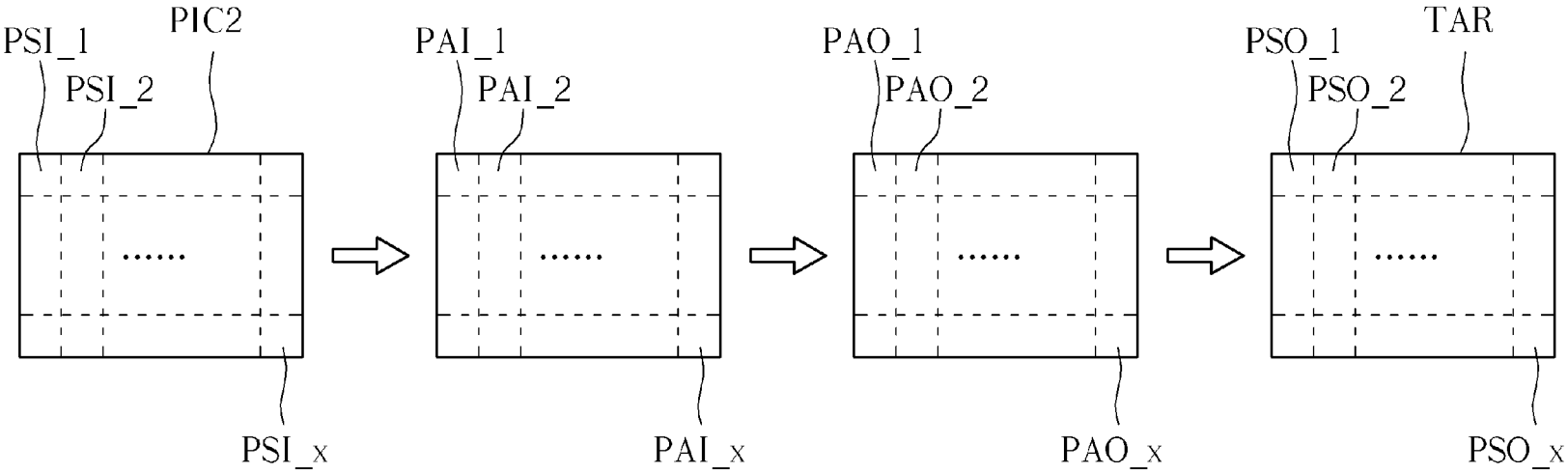
FIG. 5A is a schematic diagram of performing an image operation on a captured image to acquire a target image of an embodiment of the invention.

In Step 210, the processor device 102 performs an image operation on the captured image PIC2, acquires a target image TAR, and generates the second compensation results RES2_1-RES2_*m* according to a degree of brightness difference corresponding to the pixels PX_1-PX_m in the captured image PIC2 and the target image TAR. Please refer to FIG. 5A. FIG. 5A is a schematic diagram of performing the image operation on the captured image PIC2 to acquire the target image TAR of an embodiment of the present invention. As shown in FIG. 5A, the processor device 102 performs a two-dimensional discrete cosine transform (2D-DCT) on pixels PSI_1-PSI_x of the captured image PIC2, to generate two-dimensional transformed coefficients PAI_1-PAI_x. The processor device 102 determines whether the transformed coefficients PAI_1-PAI_x are smaller than a pre-define value PA_THR, to change the transformed coefficients of the transformed coefficients PAI_1-PAI_x, which are smaller than a pre-define value, to be 0, and generates result coefficients PAO_1-PAO_x. The processor device 102 performs a two-dimensional inverse discrete cosine transform (2D-IDCT) on the result coefficients PAO_1-PAO_x, to generate pixels PSO_1-PSO_x and acquire the target image TAR.

Figure 5B:
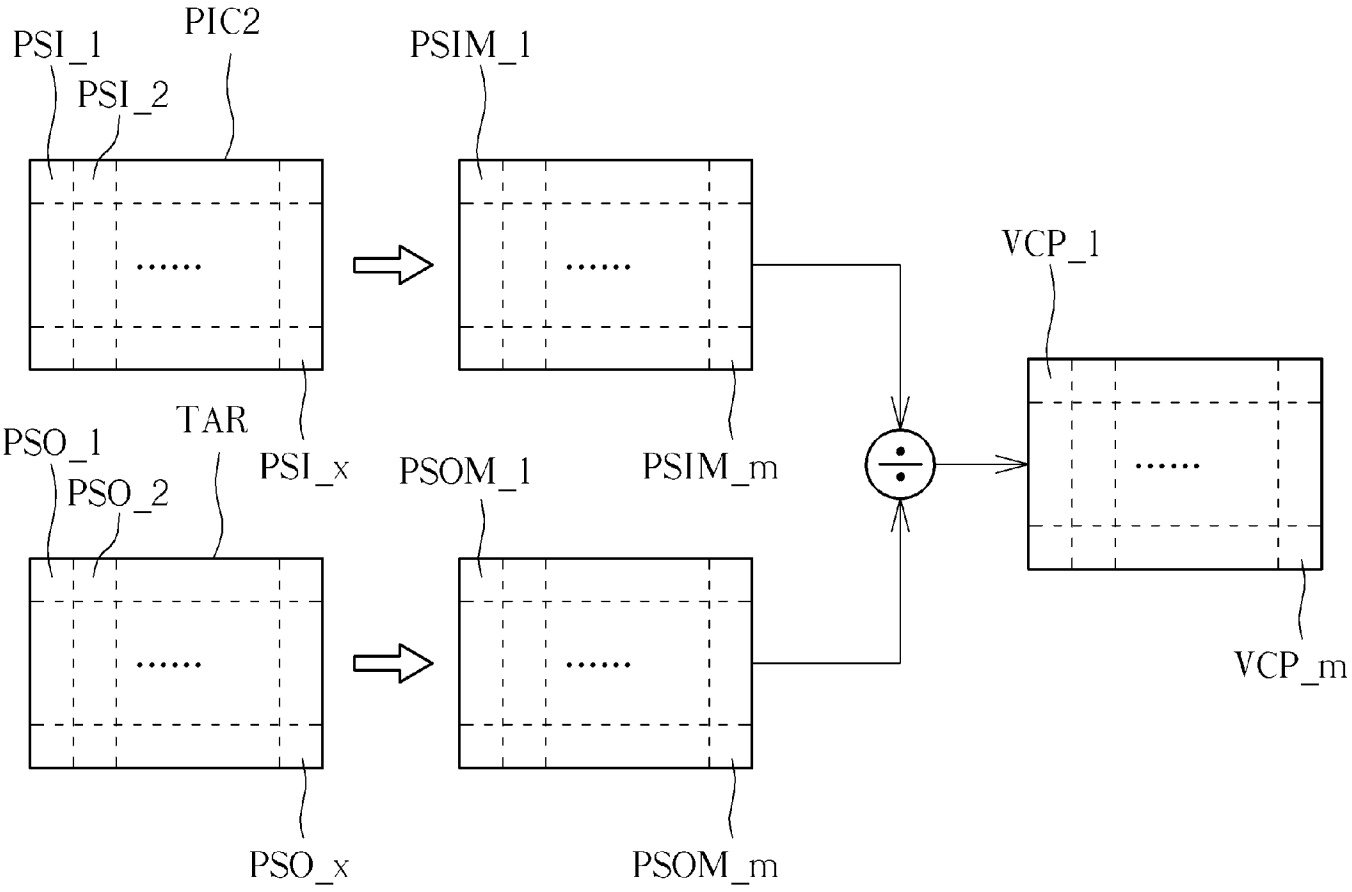
FIG. 5B is a schematic diagram of generating a plurality of pixels adjustment values based on a captured image and a target image according to an embodiment of the invention.

In addition, please refer to FIG. 5B. FIG. 5B is a schematic diagram of generating pixel adjustment values VCP_1-VCP_m based on the captured image PIC2 and the target image TAR according to an embodiment of the present invention. As shown in FIG. 5B, since a pixel number of the captured image PIC2 and the target image TAR is not equal to a pixel number of the pixels PX_1-PX_m of the display panel 110, the processor device 102 selects captured pixels PSIM_1-PSIM_m corresponding to the pixels PX_1-PX_m from the pixels PSI_1-PSI_x of the captured image PIC2 according to proportional sizes of the pixels PX_1-PX_m on the display panel 110. For example, if the pixels PSI_1-PSI_x of the captured image PIC2 corresponding to the pixel PX_1 are the pixels PSI_1-PSI_2, the pixels PSI_1 is selected as the captured pixel PSIM_1. Alternatively, an average of the pixel PSI_1 and the pixel PSI_2 may also be chosen as the captured pixel PSIM_1. The way selecting the captured pixels PSIM_1-PSIM_m corresponding to the pixels PX_1-PX_m from the pixels PSI_1-PSI_x may be modified according to practical requirements, but not limited thereto. Similarly, the processor device 102 also selects target pixels PSOM_1-PSOM_m corresponding to the pixels PX_1-PX_m from the pixels PSO_1-PSO_x of the target image TAR. The processor device 102 divides pixel values of the target pixels PSOM_1-PSOM_m by pixel values of the captured pixels PSIM_1-PSIM_m, respectively, to generate the pixel adjustment values VCP_1-VCP_m.

Since the processor device 102 performs DCT on the captured image PIC2 and clips the transformed coefficients which are smaller than the pre-define value PA_THR, the target image TAR after IDCT has low-pass filtering effect, i.e., in comparison to the captured image PIC2, the target image TAR has no high-frequency mura. In such a situation, after the processor device 102 generates brightness proportions between the captured image PIC2 and the target image TAR corresponding to the pixels PX_1-PX_m (i.e., the pixel adjustment values VCP_1-VCP_m), the processor device 102 multiplies initial brightness values VIP_1-VIP_n of the pixels PX_1-PX_m by the pixel adjustment values VCP_1-VCP_m, respectively, to acquire display brightness values VOP_1-VOP_m, for compensating the display brightness of the pixels PX_1-PX_m as display brightness of the target pixels PSOM_1-PSOM_m in the target image TAR, to be the second compensation results RES2_1-RES2_*m*, and stores the second compensation results RES2_1-RES2_*m* in the storage unit 116.

In Step 212, the driving control unit 114 accesses the display brightness values VOP_1-VOP_m from the storage unit 116, and configures the display brightness of the pixels PX_1-PX_m to be the display brightness values VOP_1-VOP_m, such that the display panel 110 displays an image equivalent to the target image TAR (i.e., the image without high-frequency mura), to eliminate the non-uniform pixel bright dots in the display panel 110. Moreover, the display brightness values VOP_1-VOP_m can be treated as a gain table of the display device 104 stored in the storage unit 116, for determining the display brightness of the pixels PX_1-PX_m. The way generating the target image TAR from the captured image PIC2 is not limited to using DCT, and other methods using Fourier transform or wavelet transform, or other algorithms with low-pass filtering effect, may also be used. Modification may be made accordingly.

Figure 6:
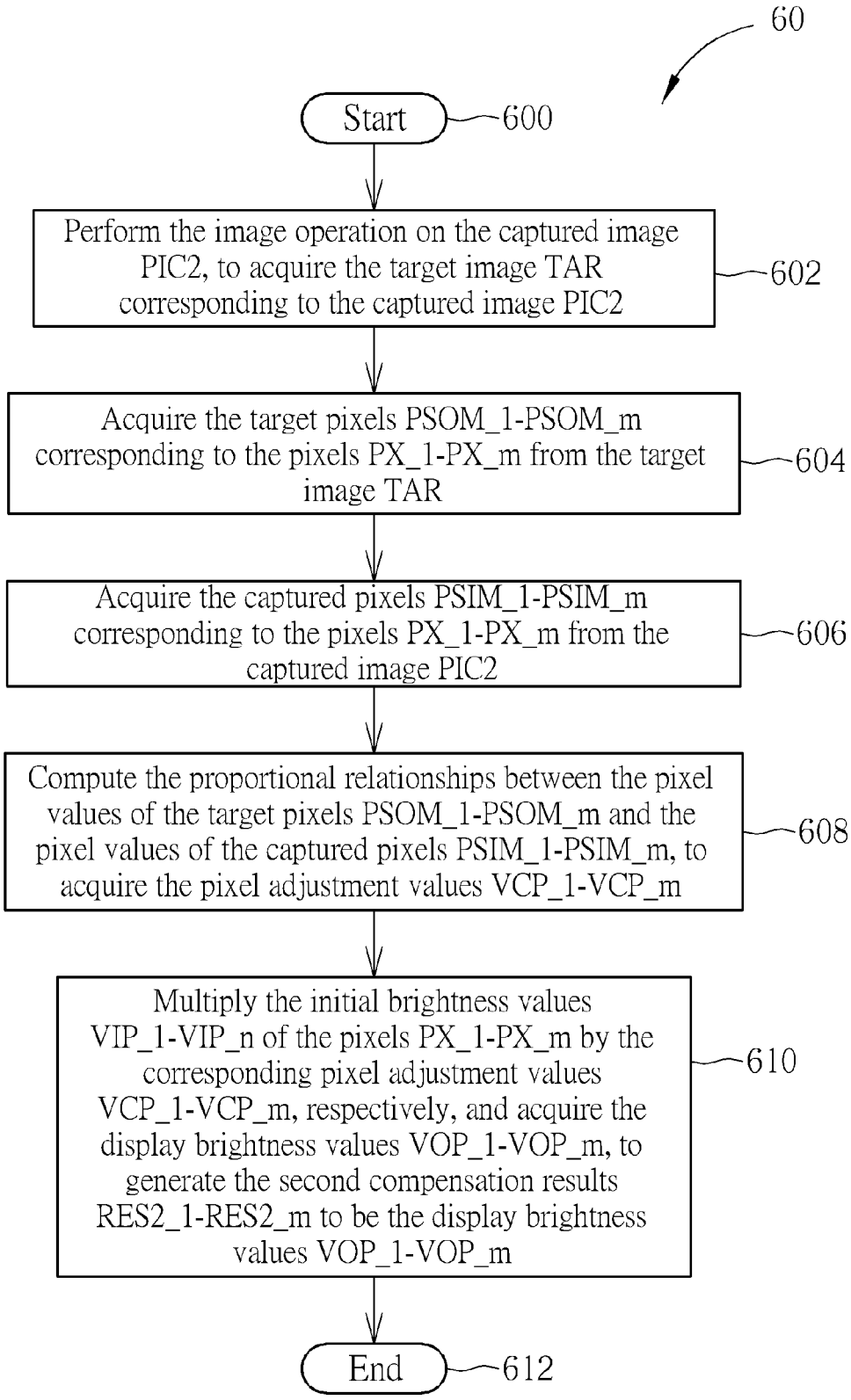
FIG. 6 is a schematic diagram of a pixel compensation process according to an embodiment of the invention.

The method of the display compensating system 10 generating the second compensation results RES2_1-RES2_*m* in Step 210 can be further summarized into a pixel compensation process 60, as shown in FIG. 6. The pixel compensation process 60 is executed by the processor device 102 in FIG. 1A, which may be compiled as programming codes and stored in the storage devices in the processor device 102 to instruct the processor(s) of the processor device 102 to perform the compensation process. The pixel compensation process 60 comprises following steps:

Step 600: Start.

Step 602: Perform the image operation on the captured image PIC2, to acquire the target image TAR corresponding to the captured image PIC2.

Step 604: Acquire the target pixels PSOM_1-PSOM_m corresponding to the pixels PX_1-PX_m from the target image TAR.

Step 606: Acquire the captured pixels PSIM_1-PSIM_m corresponding to the pixels PX_1-PX_m from the captured image PIC2.

Step 608: Compute the proportional relationships between the pixel values of the target pixels PSOM_1-PSOM_m and the pixel values of the captured pixels PSIM_1-PSIM_m, to acquire the pixel adjustment values VCP_1-VCP_m.

Step 610: Multiply the initial brightness values VIP_1-VIP_n of the pixels PX_1-PX_m by the corresponding pixel adjustment values VCP_1-VCP_m, respectively, and acquire the display brightness values VOP_1-VOP_m, to generate the second compensation results RES2_1-RES2_*m* to be the display brightness values VOP_1-VOP_m.

Step 612: End.

The details of each step of the pixel compensation process 60 can be referred to the relative paragraphs of the embodiments stated above, and are not narrated herein for brevity. Notably, in the above embodiments, the second compensation results RES2_1-RES2_*m* are the display brightness values VOP_1-VOP_m, utilized for controlling the display brightness of the pixels PX_1-PX_m as uniform. Meanwhile, the processor device 102 also determines whether the non-uniform pixel bright dots in the display panel 110 are able to be eliminated by the compensation process, according to reasonableness of the display brightness values VOP_1-VOP_m. From the determination results, the manufactured display panel 110 is decided whether or not to be discarded.

In Step 210, the processor device 102 may additionally perform a further analysis on the brightness corresponding to the pixels PX_1-PX_m in the captured image PIC2 and the target image TAR, to generate more precise second compensation results RES2_1-RES2_*m*. In detail, after the processor device 102 generates the display brightness values VOP_1-VOP_m from the pixel compensation process 60, the processor device 102 saves the display brightness values VOP_1-VOP_m as initial compensation values VOPI_1-VOPI_m. Next, the processor device 102 performs a difference extraction operation and a degree operation on the captured image PIC2 and the target image TAR, to acquire a degree value SEMU for adjusting the initial compensation values VOPI_1-VOPI_m as the more precise second compensation results RES2_1-RES2_*m*.

Figure 7A:
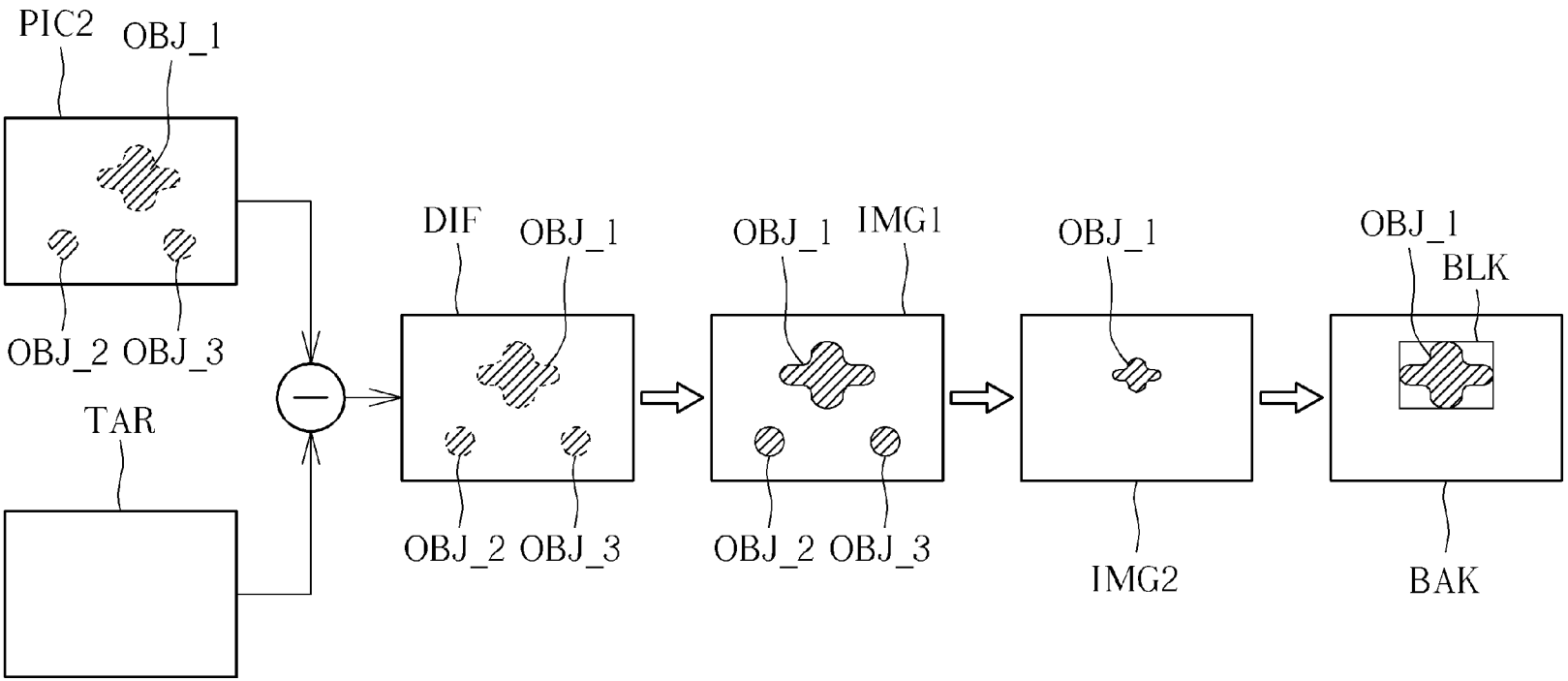
FIG. 7A is a schematic diagram of performing a difference extraction operation on a captured image and a target image to generate an object image of an embodiment of the invention.

Please refer to FIG. 7A. FIG. 7A is a schematic diagram of performing the difference extraction operation on the captured image PIC2 and the target image TAR to generate an object image OBJ of an embodiment of the present invention. As shown in FIG. 7A, the image capturing device 100 captured by the captured image PIC2 has the bright dot objects OBJ_1-OBJ_3. Since the bright dot objects OBJ_1-OBJ_3 in the captured image PIC2 is observable but not obvious, the bright dot objects OBJ_1-OBJ_3 in FIG. 7A are represented in dashed frame lines. The target image TAR is an image of the captured image PIC2 undergoing low pass filtering, and thus, the target image TAR has no high-frequency bright dot object.

In such a situation, the processor device 102 subtracts the pixel values of the pixels in the captured image PIC2 from the pixel values of the pixels in the target image TAR, to generate a difference image DIF. Next, the processor device 102 performs a binarization operation on the difference image DIF, to acquire a binarized image IMG1. The binarization operation determines whether each pixel value of pixels of the difference image DIF is greater than a pre-define value DIF_THR, changes the pixel values of the pixels of the difference image DIF which are greater than the pre-define value DIF_THR to be a maximum pixel value MAX, and changes the pixel values of the pixels of the difference image DIF which are not greater than the pre-define value DIF_THR to be a minimum pixel value MIN. Hence, the pixel values of the pixels of the binarized image IMG1 only have two kinds of values: the maximum pixel value MAX and the minimum pixel value MIN. Moreover, brightness values of the binarized bright dot objects OBJ_1-OBJ_3 are equal to the maximum pixel value MAX, having high brightness. The bright dot objects OBJ_1-OBJ_3 are obviously seen in the binarized image IMG1, such that the bright dot objects OBJ_1-OBJ_3 are represented in solid frame lines.

The processor device 102 then performs an erosion operation on the binarized image IMG1, to acquire an erosion image IMG2. The erosion operation reduces areas formed by the pixels with the maximum pixel value MAX in the binarized image IMG1, i.e., the erosion operation reduces the areas of the bright dot objects OBJ_1-OBJ_3. Hence, the bright dot objects OBJ_2-OBJ_3 with smaller areas are filtered out, leaving the bright dots object OBJ_1 in the erosion image IMG2. The processor device 102 performs a dilation operation on the erosion image IMG2, to acquire an object image BAK. The dilation operation enlarges the areas formed by the pixels with the maximum pixel value MAX in the erosion image IMG2, i.e., the dilation operation enlarges the area of the bright dots object OBJ_1 with the maximum pixel value MAX as its original size, which is the same as the size before the erosion operation.

In addition, the processor device 102 evaluates pixel values of pixels of the object image BAK, to acquire object pixels POBJ_1-POBJ_y with pixel values equal to the maximum pixel value MAX. The processor device 102 identifies an object block BLK which the bright dots object OBJ_1 locates at according to locations of the object pixels POBJ_1-POBJ_y in the object image BAK. For example, the processor device 102 regards the upmost, the leftmost, the bottommost, and the rightmost locations of the object pixels POBJ_1-POBJ_y in the object image BAK as the upmost, the leftmost, the bottommost, and the rightmost boundaries of the object block BLK, to acquire a size and a location of the rectangular object block BLK.

Figure 7B:
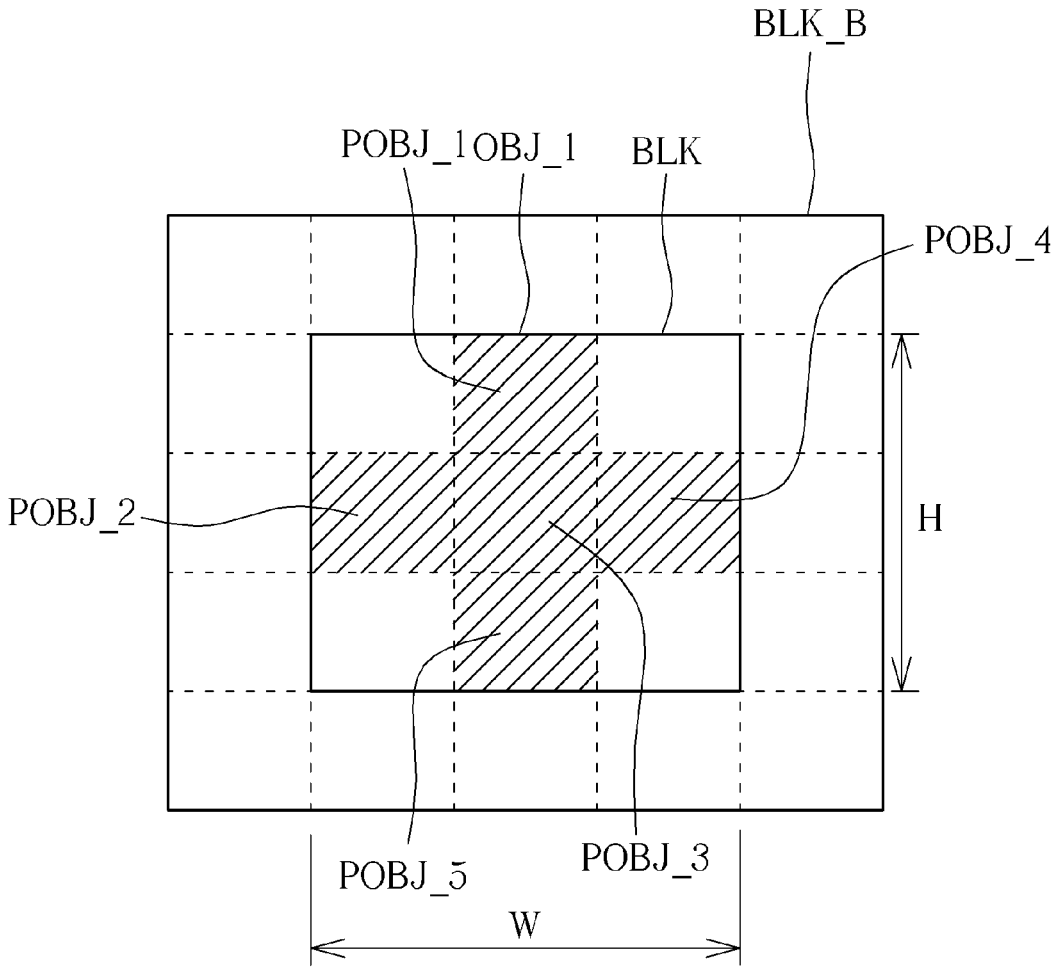
FIG. 7B is a schematic diagram of an object block in FIG. 7A.

Please refer to FIG. 7B. FIG. 7B is a schematic diagram of the object block BLK in FIG. 7A. As shown in FIG. 7B, the bright dots object OBJ_1 comprises the object pixels POBJ_1-POBJ_5, and the object pixels POBJ_1-POBJ_5 form the object block BLK with a pixel width W and a pixel height H. The processor device 102 performs the degree operation on the captured image PIC2 and the target image TAR according to the object block BLK, to acquire the degree value SEMU. First, the processor device 102 extends the object block BLK upward ⅓ of the pixel height H, downward ⅓ of the pixel height H, leftward ⅓ of the pixel width W, and rightward ⅓ of the pixel width W, forming a background block BLK_B. Next, the processor device 102 performs operations on all pixels corresponding to the object block BLK in the captured image according to the size and the location of the object block BLK, to generate an average brightness of all the pixels corresponding to the object block BLK as an average object brightness Io. Similarly, the processor device 102 performs operations on all pixels corresponding to the background block BLK_B in the target image TAR according to the size and the location of the background block BLK_B, to generate an average brightness of all the pixels corresponding to the background block BLK_B as an average background brightness Ib. Meanwhile, the processor device 102 computes an area of the bright dots object OBJ_1 corresponding to the display panel 110 in the object image BAK, to acquire an object area S in terms of square millimeter ($mm^2$). Hence, the processor device 102 acquires the degree value SEMU according to a formula related to a degree of severeness of the mura defined by Semiconductor Equipment and Materials International (SEMI) as:

$$\text{Degree value SEMU}=(\text{Average object brightness } Io-\text{verage background brightness } Ib)/((1.97/\text{Object area } S^{0.33})+0.72).$$

Finally, the processor device 102 determines whether the degree value SEMU is greater than a threshold value SEMU_THR. The processor device 102 generates the second compensation results RES2_1-RES2_*m* as the initial compensation values VOPI_1-VOPI_m when the degree value SEMU is greater than the threshold value SEMU_THR, i.e., no further adjustment is performed on the display brightness values VOP_1-VOP_m generated from the aforementioned compensation process 60. On the other hand, when the degree value SEMU is not greater than the threshold value SEMU_THR, the processor device 102 divides the degree value SEMU by the threshold value SEMU_THR, generating an overall pixel adjustment value, respectively subtracts 1 from the initial compensation values VOPI_1-VOPI_m, multiplies the initial compensation values VOPI_1-VOPI_m after subtraction by the overall pixel adjustment values, and adds 1 to the initial compensation values VOPI_1-VOPI_m after multiplication, to acquire display brightness values VOPO_1-VOPO_m as the second compensation results RES2_1-RES2_*m*. In other words, the initial compensation values VOPI_1-VOPI_m (representing the brightness proportions between the captured image PIC2 and the target image TAR corresponding to the pixels PX_1-PX_m) are further enlarged or reduced, such that the display brightness values VOPO_1-VOPO_m are more precise.

Figure 8:
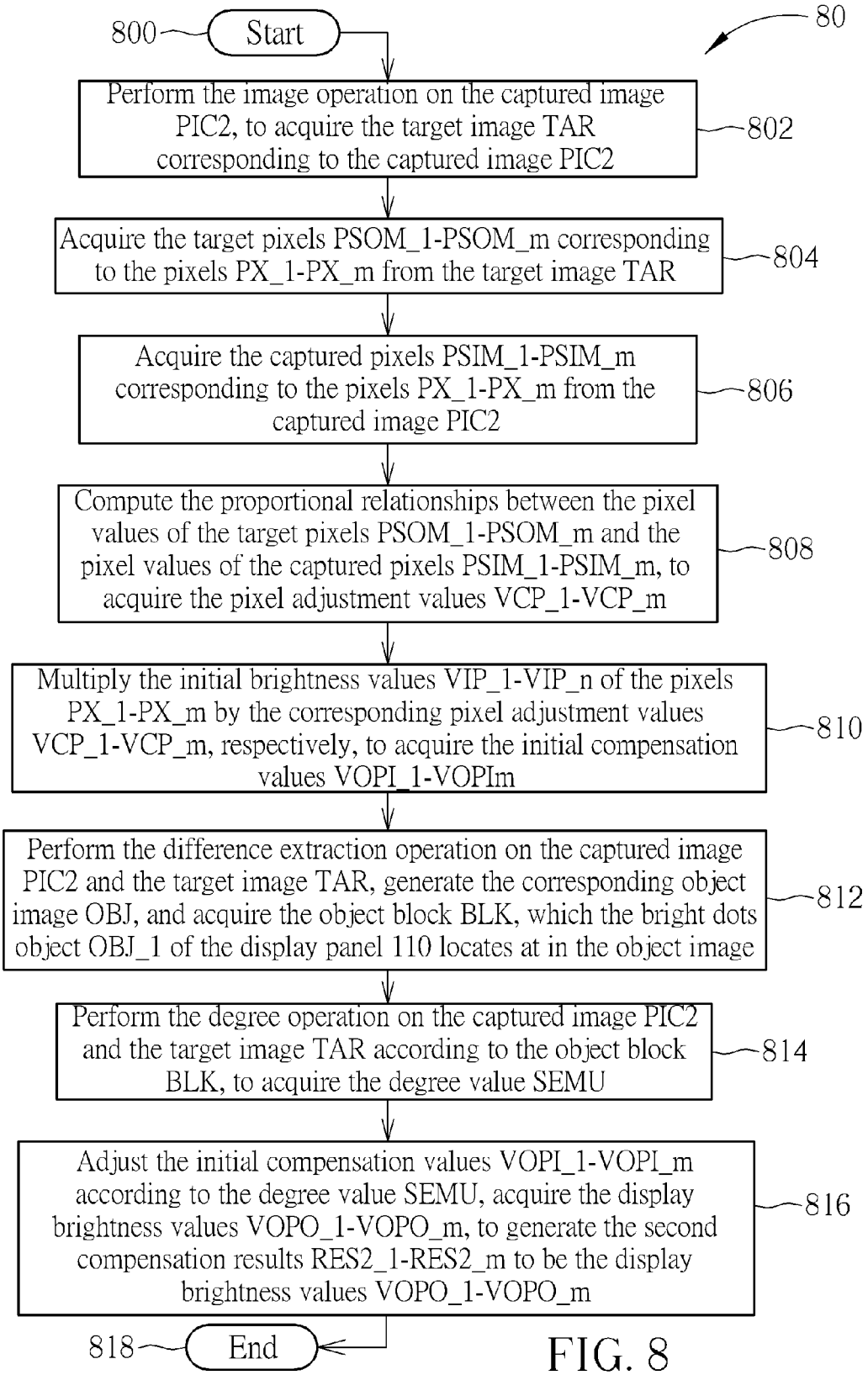
FIG. 8 is a schematic diagram of another pixel compensation process according to an embodiment of the invention.

The method of the display compensating system 10 performing the further analysis on the brightness of the pixels PX_1-PX_m in the captured image PIC2 and the target image TAR and generating the more precise second compensation results RES2_1-RES2_*m* in Step 210 can be summarized into another pixel compensation process 80, as shown in FIG. 8. The pixel compensation process 80 is executed by the processor device 102 in FIG. 1A, which may be compiled as programming codes and stored in the storage devices in the processor device 102 to instruct the processor(s) of the processor device 102 to perform the compensation process. The pixel compensation process 80 comprises following steps:

Step 800: Start.

Step 802: Perform the image operation on the captured image PIC2, to acquire the target image TAR corresponding to the captured image PIC2.

Step 804: Acquire the target pixels PSOM_1-PSOM_m corresponding to the pixels PX_1-PX_m from the target image TAR.

Step 806: Acquire the captured pixels PSIM_1-PSIM_m corresponding to the pixels PX_1-PX_m from the captured image PIC2.

Step 808: Compute the proportional relationships between the pixel values of the target pixels PSOM_1-PSOM_m and the pixel values of the captured pixels PSIM_1-PSIM_m, to acquire the pixel adjustment values VCP_1-VCP_m.

Step 810: Multiply the initial brightness values VIP_1-VIP_n of the pixels PX_1-PX_m by the corresponding pixel adjustment values VCP_1-VCP_m, respectively, to acquire the initial compensation values VOPI_1-VOPI_m.

Step 812: Perform the difference extraction operation on the captured image PIC2 and the target image TAR, generate the corresponding object image OBJ, and acquire the object block BLK, which the bright dots object OBJ_1 of the display panel 110 locates at in the object image.

Step 814: Perform the degree operation on the captured image PIC2 and the target image TAR according to the object block BLK, to acquire the degree value SEMU.

Step 814: Adjust the initial compensation values VOPI_1-VOPI_m according to the degree value SEMU, acquire the display brightness values VOPO_1-VOPO_m, to generate the second compensation results RES2_1-RES2_*m* to be the display brightness values VOPO_1-VOPO_m.

Step 816: End.

The details of each step of the pixel compensation process 80 can be referred to the relative paragraphs of the embodiments stated above, and are not narrated herein for brevity. Notably, in the above embodiments, the second compensation results RES2_1-RES2_*m* are the display brightness values VOPO_1-VOPO_m, utilized for controlling the display brightness of the pixels PX_1-PX_m as uniform. Meanwhile, the processor device 102 also determines whether the non-uniform pixel bright dots in the display panel 110 are able to be eliminated by the compensation process, according to reasonableness of the degree value SEMU or the display brightness values VOPO_1-VOPO_m. From the determination results, the manufactured display panel 110 is decided whether or not to be discarded. In addition, in comparison to the pixel compensation process 60, the pixel compensation process 80 generates the degree value SEMU according to the formula defined by SEMI, further adjusts the display brightness values VOP_1-VOP_m generated from the pixel compensation process 60, so as to generate the display brightness values VOPO_1-VOPO_m, such that the display brightness values VOPO_1-VOPO_m precisely compensate the display brightness of the pixels PX_1-PX_m, for compensating the display brightness of the pixels PX_1-PX_m as uniform, to eliminate the non-uniform pixel bright dots in the display panel 110.

In brief, the display compensation process 20 captures the image displayed by the display panel 110 as the captured image PIC1 through the image capturing device 100, and performs analysis on the captured image PIC1 to compensate the lightening brightness of the backlight elements BL_1-BL_n, for eliminating the block with non-uniform brightness. Next, the display compensation process 20 captures the image with the uniform brightness blocks as the captured image PIC2 through the image capturing device 100, and performs analysis on the captured image PIC2 to compensate the display brightness of the pixels PX_1-PX_m, for eliminating the non-uniform pixel bright dots. Notably, the analysis performed by the display compensation process 20 on the captured image PIC2 is based on the degree of brightness difference of the captured image PIC2 and the target image TAR to generate the second compensation results RES2_1-RES2_*m* for compensating the pixels PX_1-PX_m, such that the overall brightness of the display panel 110 would not be too bright or too dark caused by elimination of the mura, to enhance the manufacture yield of display panels.

Specifically, the display compensating system 10 of the present invention captures the image of the display panel 110, analyzes the brightness values of the blocks related to the backlight elements BL_1-BL_n in the captured image, and generates the compensation results for compensating the lightening brightness of the backlight elements BL_1-BL_n, such that the display panel 110 displays the image with the uniform brightness display blocks. Furthermore, the display compensating system 10 captures the image with the uniform brightness display blocks displayed by the display panel 110, analyzes the brightness values of the pixels related to the pixels PX_1-PX_m in the captured image, and generates the compensation results for compensating the display brightness of the pixels PX_1-PX_m, such that the display panel 110 displays the image with the uniform brightness pixels, and eliminates the mura. Notably, according to the aforementioned description, modifications and alternations can be made accordingly by those skilled in the art. For example, in this embodiment, the display compensating system 10 compensates both the backlight elements BL_1-BL_n and the pixels PX_1-PX_m, which makes the display panel 110 have the uniform brightness display blocks first and then makes the brightness of the pixels be uniform, eliminating the mura in the display panel 110 easily, without causing too bright or too dark due to the elimination of the mura. In other embodiments, the display compensating system 10 may purely compensate the lightening brightness of the backlight elements BL_1-BL_n or the display brightness of the pixels PX_1-PX_m. Modification may be made according to practical requirements and not limited herein.

In addition, in this embodiment, the display compensating system 10 performs the difference extraction operation on the captured image PIC2 and the target image TAR, and generates the corresponding object image OBJ, to acquire the object block BLK which the bright dots object OBJ_1 of the display panel 110 locates at in the object image; wherein a number of the bright dots objects is not limited to be single one. In other embodiments, multiple bright dots objects may exist in the object image OBJ obtained from the difference extraction operation. After the display compensating system 10 computes degree values corresponding to the multiple bright dots objects, the display compensating system 10 chooses a minimum value or an average value of the multiple degree values as the degree value SEMU of the display brightness of the compensated pixels.

In addition, in this embodiment, the first compensation results RES1_1-RES1_*n* are the lightening brightness values VOL_1-VOL_n for controlling the lightening brightness of the backlight elements BL_1-BL_n as uniform, and the second compensation results RES2_1-RES2_*m* are the display brightness values VOP_1-VOP_m for controlling the display brightness of the pixels PX_1-PX_m as uniform. In other embodiments, the first compensation results RES1_1-RES1_*n* or the second compensation results RES2_1-RES2_*m* may also include other information for determining whether to control the lightening brightness of the backlight elements BL_1-BL_n or the display brightness of the pixels PX_1-PX_m. For example, when a case that a non-uniform bright dot pixel not able to be eliminated are determined, a decision result is generated to cease the compensation on the display brightness of the pixels PX_1-PX_m and discard the manufactured display panel 110. Modification may be made according to practical requirements and not limited herein.

In summary, the prior art method, which relies on personal subjective determinants made by the testing staff concerning whether a mura is in a display panel and discards the display panel with the mura, may result in the testing results being inconsistent or unreliable, causing some sold panels to be rejected by customers or the manufacture yield to be too low. On the contrary, the display compensation process of the present invention captures the image displayed by the display panel, performs the analysis, and generates the compensation results. Whether a mura appears in a display panel is precisely justified according to the compensation results. In addition, the display compensation is performed to eliminate the mura, to enhance the manufacture yield of the display panel.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display compensating method, for eliminating a mura of a display panel, comprising:

capturing an first image displayed by the display panel, for generating a first captured image;

generating a plurality of first compensation results according to a plurality of brightness values corresponding to a plurality of first display units of the display panel in the first captured image;

configuring brightness of the plurality of first display units and displaying a second image according to the plurality of first compensation results;

capturing the second image displayed by the display panel, for generating a second captured image;

generating a plurality of second compensation results according to the second captured image; and configuring brightness of the plurality of second display units according to the plurality of second compensation results, for eliminating the mura of the display panel;

wherein the plurality of first display units are separated according to a plurality of display blocks classified by locations of a plurality of backlight elements corresponding to the display panel;

wherein the step of generating the plurality of first compensation results according to the brightness values corresponding to the plurality of first display units of the display panel in the first captured image comprises:

performing operations on pixels in the first captured image, to acquire an overall average brightness value;

dividing the first captured image into a plurality of image blocks corresponding to the plurality of display blocks according to proportional sizes of the plurality of display blocks on the display panel, and performing operations on pixels in the plurality of image blocks, to acquire a plurality of average brightness values; and generating the plurality of first compensation results according to the overall average brightness value and the plurality of average brightness values;

wherein the step of generating the plurality of first compensation results according to the overall average brightness value and the plurality of average brightness values comprises:

dividing the overall average brightness value by the plurality of average brightness values respectively, to acquire a plurality of backlight adjustment values; and multiplying a plurality of initial brightness values of the plurality of backlight elements by the plurality of backlight adjustment values corresponding to the plurality of initial brightness values respectively, to acquire a plurality of lightening brightness values, and to generate the plurality of first compensation results to be the plurality of lightening brightness values.

2. The display compensating method of claim 1, wherein the first image and the second image displayed by the display panel are monochrome images with a uniform color.

3. The display compensating method of claim 1, wherein block centers of the plurality of first display units are the locations of the plurality of backlight elements corresponding to the display panel.

4. The display compensating method of claim 1, wherein the overall average brightness value is obtained by dividing a summation of pixel values of the pixels in the first captured image by a total number of pixels in the first captured image, and the plurality of average brightness values are respectively obtained by dividing summations of pixel values of the pixels in the plurality of image blocks by total numbers of pixels in the plurality of image blocks.

5. The display compensating method of claim 1, wherein the step of configuring the brightness of the plurality of first display units according to the plurality of first compensation results comprises:

controlling lightening brightness of the plurality of backlight elements as the plurality of lightening brightness values in the plurality of first compensation results, to configure the brightness of the plurality of display blocks.

6. A display compensating method, for eliminating a mura of a display panel, comprising:

capturing an first image displayed by the display panel, for generating a first captured image;

generating a plurality of first compensation results according to a plurality of brightness values corresponding to a plurality of first display units of the display panel in the first captured image;

configuring brightness of the plurality of first display units and displaying a second image according to the plurality of first compensation results;

capturing the second image displayed by the display panel, for generating a second captured image;

generating a plurality of second compensation results according to the second captured image; and configuring brightness of the plurality of second display units according to the plurality of second compensation results, for eliminating the mura of the display panel;

wherein the plurality of second display units are a plurality of pixels of the display panel;

wherein the step of generating the plurality of second compensation results according to the plurality of brightness values corresponding to the plurality of second display units of the display panel in the second captured image further comprises:

performing an image operation on the second captured image, to acquire a target image corresponding to the second captured image;

generating the plurality of second compensation results according to a degree of brightness difference corresponding to the plurality of pixels in the second captured image and the target image;

wherein the step of generating the plurality of second compensation results according to the degree of brightness difference corresponding to the plurality of pixels in the second captured image and the target image comprises:

acquiring a plurality of target pixels corresponding to the plurality of pixels from the target image;

acquiring a plurality of captured pixels corresponding to the plurality of pixels from the second captured image;

computing proportional relationships between pixel values of the plurality of target pixels and pixel values of the plurality of captured pixels, to acquire a plurality of pixel adjustment values; and multiplying initial display brightness values of the plurality of pixels by the plurality of pixels adjustment values corresponding to the plurality of pixels respectively, to acquire a plurality of display brightness values, and generate the plurality of second compensation results to be the plurality of display brightness values.

7. The display compensating method of claim 6, wherein the image operation is performed according to an image algorithm with low-pass filtering effect.

8. The display compensating method of claim 6, wherein the step of performing the image operation on the second captured image to acquire the target image corresponding to the second captured image comprises:

performing a two-dimensional discrete cosine transform (2D-DCT) on the second captured image, to generate a plurality of transformed coefficients;

changing coefficients of the plurality of transformed coefficients, which are smaller than a pre-define value, to be 0, to generate a plurality of result coefficients; and performing a two-dimensional inverse discrete cosine transform (2D-IDCT) corresponding to the 2D-DCT on the plurality of result coefficients, to acquire the target image.

9. The display compensating method of claim 6, wherein the plurality of pixels adjustment values are obtained by dividing the pixel values of the plurality of target pixels by the pixel values of the plurality of captured pixels, respectively.

10. The display compensating method of claim 6, wherein the step of configuring the brightness of the plurality of second display units according to the plurality of second compensation results comprises:

configuring display brightness of the plurality of pixels as the display brightness values in the plurality of second compensation results.

11. The display compensating method of claim 6, wherein the step of generating the plurality of second compensation results according to the degree of brightness difference corresponding to the plurality of pixels in the second captured image and the target image further comprises:

acquiring a plurality of target pixels corresponding to the plurality of pixels from the target image;

acquiring a plurality of captured pixels corresponding to the plurality of pixels from the second captured image;

computing proportional relationships between pixel values of the plurality of target pixels and pixel values of the plurality of captured pixels, to acquire a plurality of pixel adjustment values;

multiplying initial display brightness values of the plurality of pixels by the plurality of pixels adjustment values corresponding to the plurality of pixels respectively, to acquire a plurality of initial compensation values;

performing a difference extraction operation on the second captured image and the target image, to generate an object image, and acquire an object block from the object image which the mura locates at;

performing a degree operation on the second captured image and the target image according to the object block, to acquire a degree value; and adjusting the plurality of initial compensation values according to the degree value, to acquire a plurality of display brightness values, and generate the plurality of second compensation results to be the plurality of display brightness value.

12. The display compensating method of claim 11, wherein the step of performing the difference extraction operation on the second captured image and the target image, to generate the object image, and acquire the object block from the object image which the mura locates at comprises:

subtracting the pixel values of the pixels in the second captured image from the pixel values of the pixels in the target image, to generate a difference image;

performing a binarization operation, an erosion operation and a dilation operation in sequence on the difference image, to generate the object image; and acquiring the object block in the object image which the mura locates at according to pixel values of the pixels in the object image.

13. The display compensating method of claim 12, wherein the step of performing the binarization operation, the erosion operation and the dilation operation in sequence on the difference image to generate the object image comprises:

changing pixel values of pixels of the difference image, which are greater than a pre-define value, to be a maximum pixel value, and changing pixel values of the pixels of the difference image, which are not greater than the pre-define value, to be a minimum pixel value, to generate a binarized image;

reducing an area formed by pixels with the maximum pixel value in the binarized image, to generate an erosion image; and enlarging an area formed by pixels with the maximum pixel value in the erosion image, to generate the object image.

14. The display compensating method of claim 12, wherein the step of acquiring the object block in the object image which the mura locates at according to the pixel values of the pixels in the object image comprises:

evaluating pixel values of pixels of the object image, to acquire a plurality of object pixels with pixel values equal to a decision value from the pixels of the object image; and determining the object block in the object image which the mura locates at according to locations of the plurality of object pixels in the object image.

15. The display compensating method of claim 11, wherein the step of performing the degree operation on the second captured image and the target image according to the object block to acquire the degree value comprises:

extending the object block as a background block;

performing operations on pixels corresponding to the object block in the second captured image, to generate an average object brightness;

performing operations on pixels of the background block corresponding to the target image, to generate an average background brightness;

acquiring an object area of the object block; and executing $(Io-Ib)/((1.97/S^{0.33})+0.72)$, to acquire the degree value;

wherein Io, Ib, and S represent the average object brightness, the average background brightness, and the object area, respectively.

16. The display compensating method of claim 11, wherein the step of adjusting the plurality of initial compensation values according to the degree value to acquire the plurality of display brightness values comprises:

determining whether the degree value is greater than a threshold value; and acquiring the plurality of display brightness values as the plurality of initial compensation values when the degree value is greater than the threshold value, and adjusting the plurality of initial compensation values when the degree value is not greater than the threshold value, to acquire the plurality of display brightness values.

17. The display compensating method of claim 16, wherein the step of adjusting the plurality of initial compensation values when the degree value is not greater than the threshold value to acquire the plurality of display brightness values comprises:

dividing the degree value by the threshold value, to acquire an overall pixel adjustment value; and respectively subtracting 1 from the plurality of initial compensation values, multiplying the plurality of initial compensation values after subtracted by 1 by the overall pixel adjustment values, and adding 1 to the plurality of initial compensation values after multiplied by the overall pixel adjustment values, to acquire the plurality of display brightness values.

18. A display compensating system, comprising:

a display device, for displaying a first image and a second image, the display device comprising:

a plurality of first display units;

a display panel, comprising a plurality of second display units;

a storage unit, for storing a plurality of first compensation results and a plurality of second compensation results; and a control unit, coupled to the display panel, the plurality of first display units and the storage unit, for configuring a plurality of brightness of the plurality of first display units according to the plurality of first compensation results, such that the display device displays the second image according to the plurality of first compensation results;

an image capturing device, for capturing the first image displayed by the display panel to generate a first captured image, and capturing the second image to generate a second captured image; and a processor device, coupled to the image capturing device and the display panel, for generating the plurality of first compensation results according to a plurality of brightness values corresponding to the plurality of first display units of the display panel in the first captured image, generating the plurality of second compensation results according to a plurality of brightness values corresponding to the plurality of second display units of the display panel in the second captured image, and storing the plurality of first compensation results and the plurality of second compensation results in the storage unit of display device;

wherein the display compensating system configures the plurality of brightness values of the plurality of second display units according to the plurality of second compensation results, to eliminate the mura of the display panel;

wherein the plurality of first display units are separated according to a plurality of display blocks classified by locations of a plurality of backlight elements corresponding to the display panel, and the control unit configures the brightness of the plurality of first display units via controlling lightening brightness of the plurality of backlight elements;

wherein the processor device is further utilized for performing following steps, for generating the plurality of first compensation results according to the brightness values corresponding to the plurality of first display units of the display panel in the first captured image:

performing operations on pixels in the first captured image, to acquire an overall average brightness value;

dividing the first captured image into a plurality of image blocks corresponding to the plurality of display blocks according to proportional sizes of the plurality of display blocks on the display panel, and performing operations on pixels in the plurality of image blocks, to acquire a plurality of average brightness values; and generating the plurality of first compensation results according to the overall average brightness value and the plurality of average brightness values;

wherein the processor device is further utilized for performing following steps, for generating the plurality of first compensation results according to the overall average brightness value and the plurality of average brightness values:

dividing the overall average brightness value by the plurality of average brightness values respectively, to acquire a plurality of backlight adjustment values; and multiplying a plurality of initial brightness values of the plurality of backlight elements by the plurality of backlight adjustment values corresponding to the plurality of initial brightness values respectively, to acquire a plurality of lightening brightness value, and to generate the plurality of first compensation results to be the plurality of lightening brightness value.

19. The display compensating system of claim 18, wherein the first image and the second image displayed by the display panel are monochrome images with a uniform color.

20. The display compensating system of claim 18, wherein block centers of the plurality of first display units are the locations of the plurality of backlight elements corresponding to the display panel.

21. The display compensating system of claim 18, wherein the overall average brightness value is obtained by dividing a summation of pixel values of the pixels in the first captured image by a total number of pixels in the first captured image, and the plurality of average brightness value are respectively obtained by dividing summations of pixel values of the pixels in the plurality of image blocks by total numbers of pixels in the plurality of image blocks.

22. The display compensating system of claim 18, wherein the processor device is further utilized for performing following step, for configuring the brightness of the plurality of first display units according to the plurality of first compensation results:

controlling the lightening brightness of the plurality of backlight elements as the plurality of lightening brightness values in the plurality of first compensation results, to configure the brightness of the plurality of display blocks.

23. A display compensating system, comprising:

a display device, for displaying a first image and a second image, the display device comprising:

a plurality of first display units;

a display panel, comprising a plurality of second display units;

a storage unit, for storing a plurality of first compensation results and a plurality of second compensation results; and a control unit, coupled to the display panel, the plurality of first display units and the storage unit, for configuring a plurality of brightness of the plurality of first display units according to the plurality of first compensation results, such that the display device displays the second image according to the plurality of first compensation results;

an image capturing device, for capturing the first image displayed by the display panel to generate a first captured image, and capturing the second image to generate a second captured image; and a processor device, coupled to the image capturing device and the display panel, for generating the plurality of first compensation results according to a plurality of brightness values corresponding to the plurality of first display units of the display panel in the first captured image, generating the plurality of second compensation results according to a plurality of brightness values corresponding to the plurality of second display units of the display panel in the second captured image, and storing the plurality of first compensation results and the plurality of second compensation results in the storage unit of display device;

wherein the display compensating system configures the plurality of brightness values of the plurality of second display units according to the plurality of second compensation results, to eliminate the mura of the display panel;

wherein the plurality of second display units are a plurality of pixels of the display panel;

wherein the processor device is further utilized for performing following steps, for generating the plurality of second compensation results according to the plurality of brightness values corresponding to the plurality of second display units of the display panel in the second captured image:

performing an image operation on the second captured image, to acquire a target image corresponding to the second captured image;

generating the plurality of second compensation results according to a degree of brightness difference corresponding to the plurality of pixels in the second captured image and the target image;

wherein the processor device is further utilized for performing following steps, for generating the plurality of second compensation results according to the degree of brightness difference corresponding to the plurality of pixels in the captured image and the target image:

acquiring a plurality of target pixels corresponding to the plurality of pixels from the target image;

acquiring a plurality of captured pixels corresponding to the plurality of pixels acquiring a plurality of captured pixels corresponding to the plurality of pixels from the second captured image;

computing proportional relationships between pixel values of the plurality of target pixels and pixel values of the plurality of captured pixels, to acquire a plurality of pixel adjustment values; and multiplying initial display brightness values of the plurality of pixels by the plurality of pixels adjustment values corresponding to the plurality of pixels respectively, to acquire a plurality of display brightness value, and generate the plurality of second compensation results to be the plurality of display brightness value.

24. The display compensating system of claim 23, wherein the image operation is performed according to an image algorithm with low-pass filtering effect.

25. The display compensating system of claim 23, wherein the processor device is further utilized for performing following steps, for performing the image operation on the second captured image to acquire the target image corresponding to the second captured image:

performing a two-dimensional discrete cosine transform (2D-DCT) on the second captured image, to generate a plurality of transformed coefficients;

changing the coefficients of the plurality of transformed coefficients, which are smaller than a pre-define value, to be 0, to generate a plurality of result coefficients; and performing a two-dimensional inverse discrete cosine transform (2D-IDCT) corresponding to the 2D-DCT on the plurality of result coefficients, to acquire the target image.

26. The display compensating system of claim 23, wherein the plurality of pixels adjustment values are obtained by dividing the pixel values of the plurality of target pixels by the pixel values of the plurality of captured pixels, respectively.

27. The display compensating system of claim 23, wherein the processor device is further utilized for performing following step, for configuring the brightness of the plurality of second display units according to the plurality of second compensation results:

configuring display brightness of the plurality of pixels as the display brightness values in the plurality of second compensation results.

28. The display compensating system of claim 23, wherein the processor device is further utilized for performing following steps, for generating the plurality of second compensation results according to the degree of brightness difference corresponding to the plurality of pixels in the second captured image and the target image:

acquiring a plurality of target pixels corresponding to the plurality of pixels from the target image;

acquiring a plurality of captured pixels corresponding to the plurality of pixels from the second captured image;

computing proportional relationships between pixel values of the plurality of target pixels and pixel values of the plurality of captured pixels, to acquire a plurality of pixel adjustment values;

multiplying initial display brightness values of the plurality of pixels by the plurality of pixels adjustment values corresponding to the plurality of pixels respectively, to acquire a plurality of initial compensation values;

performing a difference extraction operation on the second captured image and the target image, to generate an object image, and acquire an object block from the object image which the mura locates at;

performing a degree operation on the second captured image and the target image according to the object block, to acquire a degree value; and adjusting the plurality of initial compensation values according to the degree value, to acquire a plurality of display brightness values, and generate the plurality of second compensation results to be the plurality of display brightness value.

29. The display compensating system of claim 28, wherein the processor device is further utilized for performing following steps, for performing the difference extraction operation on the second captured image and the target image, to generate the object image, and acquire the object block from the object image which the mura locates at comprises:

subtracting the pixel values of the pixels in the second captured image from the pixel values of the pixels in the target image, to generate a difference image;

performing a binarization operation, an erosion operation and a dilation operation in sequence on the difference image, to generate the object image; and acquiring the object block in the object image which the mura locates at according to pixel values of the pixels in the object image.

30. The display compensating system of claim 29, wherein the processor device is further utilized for performing following steps, for performing the binarization operation, the erosion operation and the dilation operation in sequence on the difference image to generate the object image:

changing pixel values of pixels of the difference image, which are greater than a pre-define value, to be a maximum pixel value, and changing pixel values of the pixels of the difference image, which are not greater than the pre-define value, to be a minimum pixel value, to generate a binarized image;

reducing an area formed by pixels with the maximum pixel value in the binarized image, to generate an erosion image; and enlarging an area formed by pixels with the maximum pixel value in the erosion image, to generate the object image.

31. The display compensating system of claim 29, wherein the processor device is further utilized for performing following steps, for acquiring the object block in the object image which the mura locates at according to the pixel values of the pixels in the object image:

evaluating pixel values of pixels of the object image, to acquire a plurality of object pixels with pixel values equal to a decision value from the pixels of the object image; and determining the object block in the object image which the mura locates at according to locations of the plurality of object pixels in the object image.

32. The display compensating system of claim 28, wherein the processor device is further utilized for performing following steps, for performing the degree operation on the second captured image and the target image according to the object block to acquire the degree value:

extending the object block as a background block;

performing operations on pixels corresponding to the object block in the second captured image, to generate an average object brightness;

performing operations on pixels of the background block corresponding to the target image, to generate an average background brightness;

acquiring an object area of the object block; and executing $(Io-Ib)/((1.97/S^{0.33})+0.72)$, to acquire the degree value;

wherein Io, Ib, and S represent the average object brightness, the average background brightness, and the object area, respectively.

33. The display compensating system of claim 28, wherein the processor device is further utilized for performing following steps, for adjusting the plurality of initial compensation values according to the degree value to acquire the plurality of display brightness values:

determining whether the degree value is greater than a threshold value; and acquiring the plurality of display brightness values as the plurality of initial compensation values when the degree value is greater than the threshold value, and adjusting the plurality of initial compensation values when the degree value is not greater than the threshold value, to acquire the plurality of display brightness values.

34. The display compensating system of claim 33, wherein the processor device is further utilized for performing following steps, for adjusting the plurality of initial compensation values when the degree value is not greater than the threshold value to acquire the plurality of display brightness values:

dividing the degree value by the threshold value, to acquire an overall pixel adjustment value; and respectively subtracting 1 from the plurality of initial compensation values, multiplying the plurality of initial compensation values after subtracted by 1 by the overall pixel adjustment values, and adding 1 to the plurality of initial compensation values after multiplied by the overall pixel adjustment values, to acquire the plurality of display brightness values.

* * * * *